US005996264A

United States Patent [19]

Nagel

[11] Patent Number: 5,996,264

[45] Date of Patent: Dec. 7, 1999

[54] SIGN HOLDER FOR TICKET MOLDINGS, STRIP FORM LABEL CARRIERS AND THE LIKE

[75] Inventor: Thomas O. Nagel, Blairstown, N.J.

[73] Assignee: Trion Industries, Inc., Wilkes-Barre, Pa.

[21] Appl. No.: 09/036,456

[22] Filed: Mar. 6, 1998

[51] Int. Cl.[6] ..... G09F 3/20

[52] U.S. Cl. ..... 40/649; 40/661.03; 40/666; 40/651; 24/3.12; 248/316.7

[58] Field of Search ..... 40/661.03, 666, 40/649, 651; 24/3.12, 563; 248/231.81, 316.7

[56] References Cited

U.S. PATENT DOCUMENTS

| | | | |
|---|---|---|---|
| 4,295,288 | 10/1981 | Westberg | 40/651 X |
| 4,557,064 | 12/1985 | Thompson | 40/661.03 |
| 4,995,182 | 2/1991 | Fast | 40/649 |
| 5,233,773 | 8/1993 | Reynolds | 40/661.03 |
| 5,472,289 | 12/1995 | Kringel et al. | 40/661.03 X |
| 5,509,634 | 4/1996 | Gebka et al. | 248/316.7 |
| 5,678,699 | 10/1997 | Gebka | 40/666 X |
| 5,715,622 | 2/1998 | Giordano, Jr. | 40/661.03 |
| 5,846,017 | 12/1998 | Meyer | 248/316.7 X |

OTHER PUBLICATIONS

Fasteners For Retail catalog entitled "1994 Buyers Guide", p. 6, Aug. 1994.

"3 Way Sign Clip" Brochure (Date unknown).

*Primary Examiner*—Brian K. Green
*Assistant Examiner*—Rodrigo J. Morales
*Attorney, Agent, or Firm*—Schweitzer Cornman Gross & Bondell LLP

[57] ABSTRACT

A sign holder device for mounting on the projecting lower margin of a display shelf ticket molding or label holder. The device is of injection molded construction having spaced apart side walls joined by top and bottom walls. A pair of mounting clips extend rearwardly and then upwardly from the bottom wall in general alignment with the respective through openings. Resilient plastic tabs, extending forwardly from the mounting clips, allow the device to be mounted on a variety of label holder configurations, where the label holders have a downwardly projecting lower edge margin to be received in the mounting clip. Abutment clips project rearwardly from the sidewalls toward the mounting clips and define locking recesses adjacent the bottom of the sign holder. This enables the sign holder to be applied over the lower edge of a flanged ticket molding and to be lockingly retained thereon by engagement of the lower flange within the locking recess.

7 Claims, 4 Drawing Sheets

SIGN HOLDER FOR TICKET MOLDINGS, STRIP FORM LABEL CARRIERS AND THE LIKE

BACKGROUND AND SUMMARY OF THE INVENTION

In connection with mass merchandising displays, it is conventional to employ elongated label-holding strips, which are mounted on the forward edge of display shelving and extend along the full length of the shelving front edge. A commonly used form of such label holder has a shallow C-shaped cross section, with inturned flanges at the top and bottom and a shallow, concave central area extending between the flanges. Pricing and information labels are installed in the channel, with upper and lower edges of the labels being engaged by the flanges, and the body of the label being supported by the concave central portion of the cross section. This arrangement is convenient and allows for the easy positioning of the information/pricing labels horizontally along the front of the shelf, to be properly aligned with merchandise being displayed thereon.

Frequently, merchandisers like to highlight certain products, which may be a few of many displayed along elongated aisles formed by the shelving installations. For this purpose, it is known to employ sign clips, which can be installed in the label holder strip and provide for the mounting and display of special signs to feature special sales, new items or the like. Typically, such sign clips provide for the mounting of sign cards either parallel to the front edge of the shelf or at right angles thereto. The latter orientation is frequently desired for attracting the attention of a customer located down the aisle from the item being featured, such that the sign will catch the customer's eye when the customer looks down the aisle.

One advantageous form of such sign clip is marketed by Trion Industries, Inc., of Wilkes-Barre, Pa. under its product item No. P3XSHCLIP. Sign clips of this type are widely used for mounting signs at the front of ticket moldings provided along the front edges of product shelving. However, in connection with the use of such standard clips on certain types of conventional ticket moldings, particularly those of rolled steel, problems can arise from the fact that the upper groove of the molding is quite shallow and sometimes does not reliably retain the sign clip. For example, a downward blow against the top of the sign card might cause the upper portion of the sign clip to be snapped out of its shallow retaining groove.

Pursuant to one aspect of the present invention, a novel and improved form of sign clip is provided which mounts on the ticket molding by gripping the lower flange of the molding, rather than in the conventional way by engaging both the upper and lower flanges. The device of the present invention includes upwardly-opening mounting clip elements engageable with the back surface of the ticket molding and cooperating with opposed, rearwardly-extending abutment projections. The abutment projections in the mounting clips define a recess area which receives the lower flange of the ticket molding, and the abutment projections extend over the top of the lower flange of the ticket molding, firmly locking the sign clip in its installed position. The sign clip is thus reliably secured to the molding, exclusively at the lower portion thereof, and does not rely in any way upon the relatively shallow upper channel.

In accordance with another aspect of the present invention, the sign clip device of the invention is designed to accommodate installation not only upon conventional ticket molding sections, but also upon modern label holder strips of plastic construction.

Certain popular forms of shelf edge label holders have been developed which do not include upper and lower flanges for engaging edges of the label and which therefore do not accept a conventional sign clip of the type described above. A particularly desirable form of the more modern style of label holder is shown in the Westberg U.S. Pat. No. 4,295,288. Label holding devices of this improved type comprise an elongated plastic extrusion forming front and back panels joined at the bottom. The extrusion forms a continuous, open-top pocket or carrier which can be opened against a resilient closing force to receive labels at any point along the length of the carrier. At least the front panel is of clear plastic, such that the label is readily visible to the customer and scanable by electronic devices.

A preferred form of the continuous label holder, shown in the Westberg U.S. Pat. No. 4,295,288 is secured along the upper portion of the back panel to a continuous mounting strip, which is secured at the front edge of the shelving. The lower portion of the label carrier projects substantially below the lower extremity of the mounting strip. By pushing against the lower portion of the carrier, the front and back panels are spread apart at the top to facilitate placement and removal of labels.

The sign clip of the present invention is especially adapted for mounting on the above described continuous extrusion style of label holder. The new clip includes a main body having features of a generally heretofore known type for receiving and retaining sign cards in either parallel or perpendicular relation to the continuous label holder at the front of the display shelving. The device includes a pair of upwardly opening mounting clips provided at the back of the device, arranged to receive projecting lower portions of the continuous label holder strip, providing stable and reliable support for the sign clip in the manner desired. The design of the improved sign clip device is such as to facilitate its economical manufacture by injection molding procedures, such that they may be produced and marketed at economical prices.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
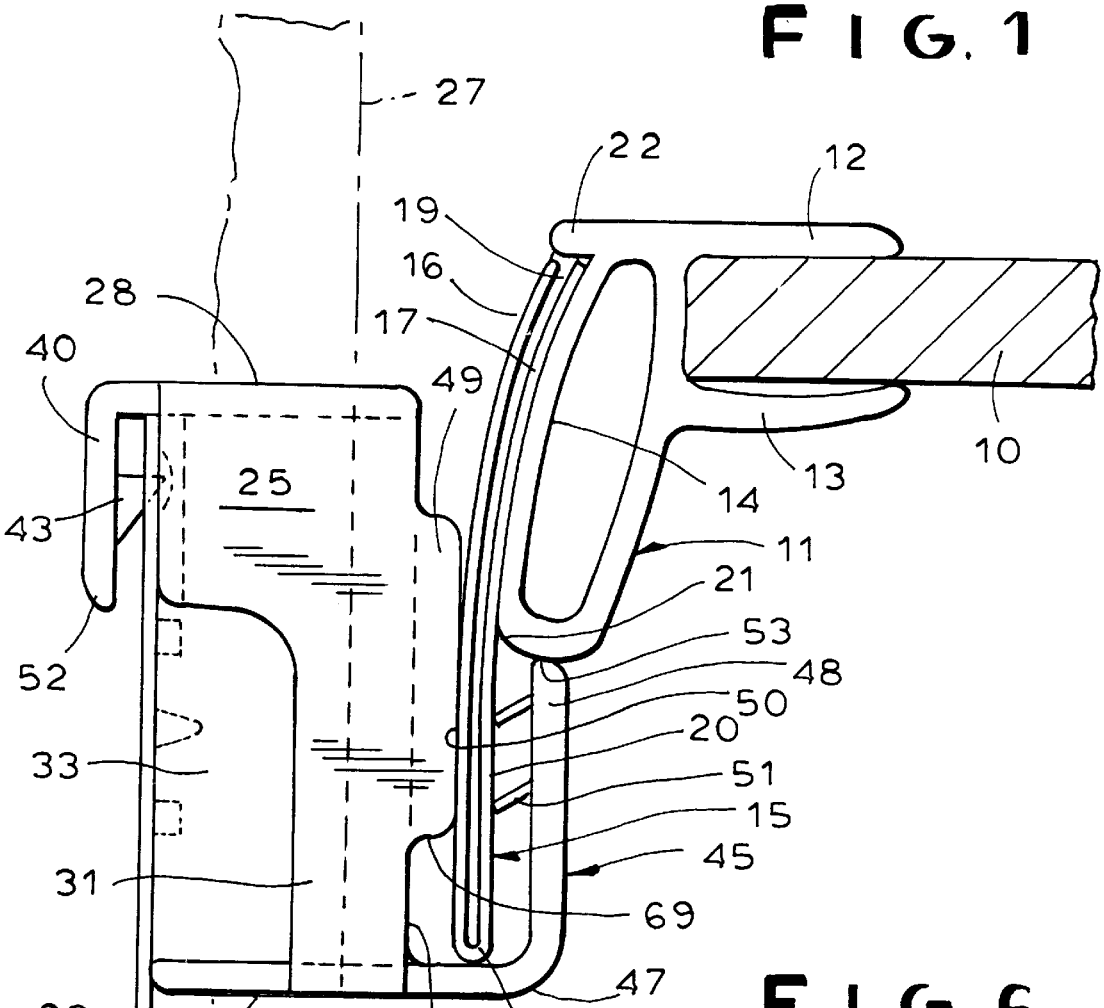
FIG. 1 is a side elevational view of the sign clip device of the invention, shown attached in a normal operating arrangement to a continuous plastic label holder.
Figure 6:
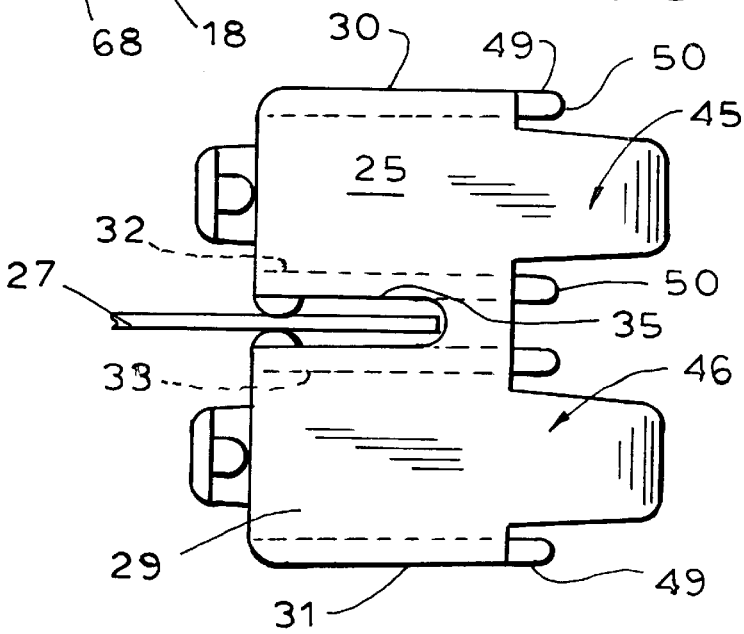
FIGS. 5 and 6 are top and bottom views respectively of the clip of FIG. 1, with a perpendicularly oriented sign shown installed in FIG. 6.
Figure 2:
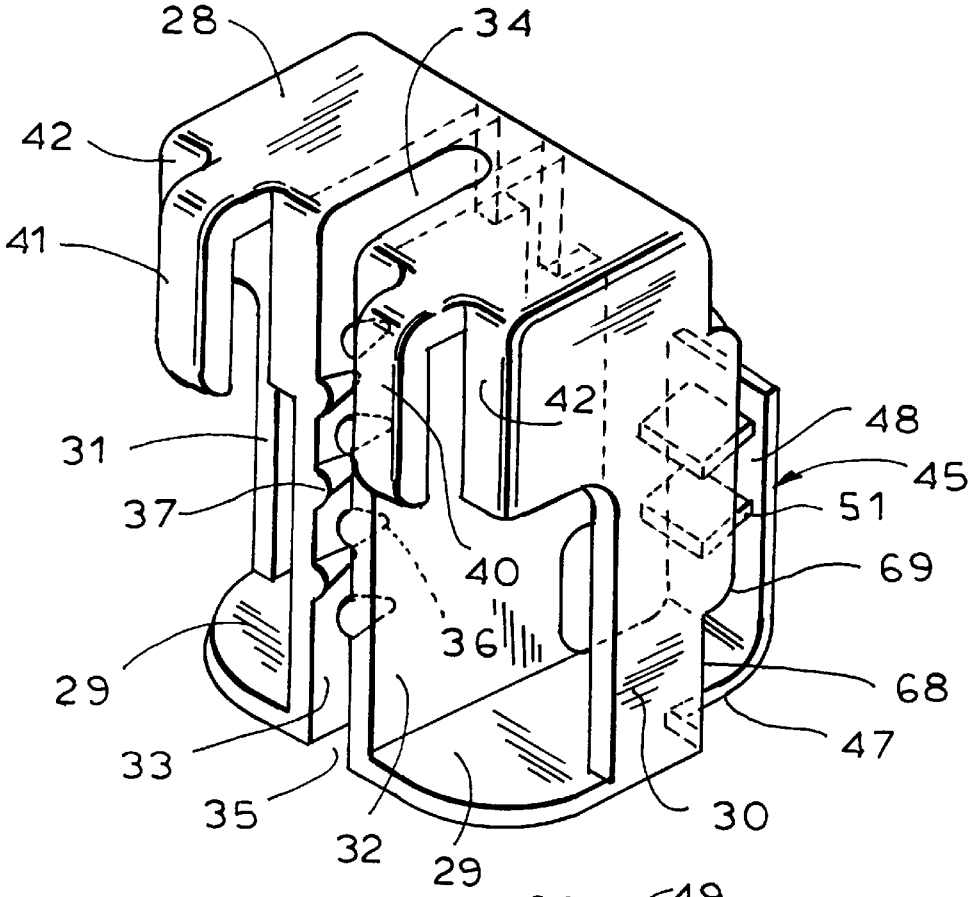
FIG. 2 is a perspective view of the sign clip of FIG. 1.
Figure 5:
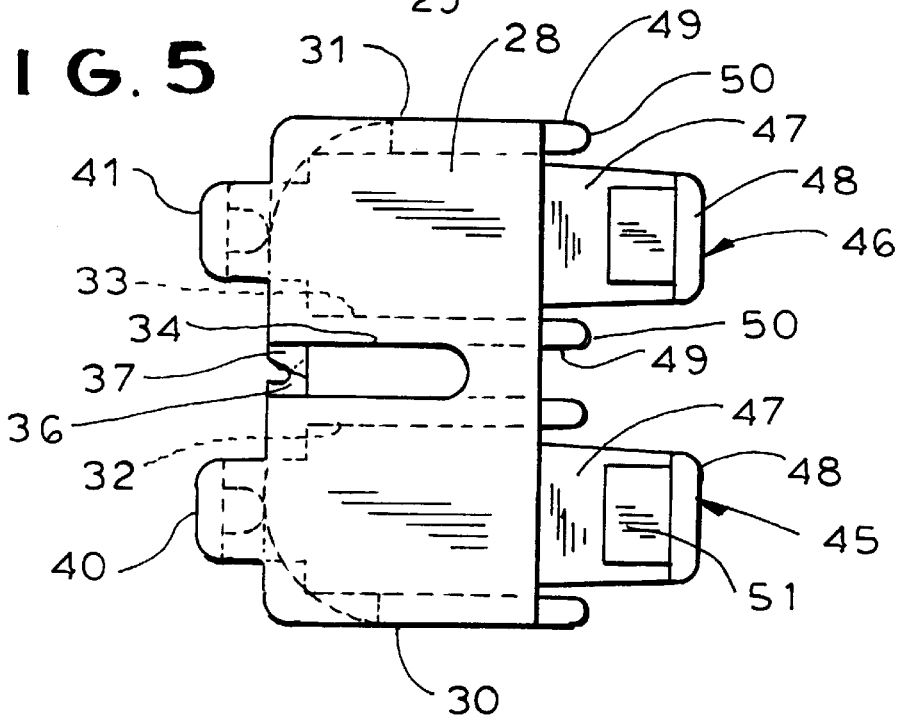

In FIG. 1, the reference numeral 10 designates a display shelf. A label holder mounting device 11, provided with upper and lower gripping flanges 12, 13 is installed over the front edge portion of the shelf and has a support body 14 projecting downward and, typically, slightly outward. A label carrier or holder 15, fixed to the mounting device 11, is comprised of front and back panels 16, 17 joined at their lower edges 18 and open at the top, as indicated at 19 in FIG. 1. Typically, the mounting device 11 and the label holder 15 can be a continuous coextrusion of plastic materials. The front and back panels 16, 17 of the label holder are formed of a relatively stiff plastic material having some degree of resilience. At the least the front panel 16 is of a clear plastic material. The two panels 16, 17 are normally resiliently urged into actual or near contact, such that the open-top pocket formed thereby is normally in an effectively closed condition. To open the label holder for the reception or removal of a thin paper label, the depending lower portion 20 of the label holder is pressed rearwardly against the fixed corner 21 of the mounting device 11. The bending action on the respective front and back panels 16, 17 forces the front panel 16 to open away from the back panel to provide access to the top of the pocket. Preferably, a forwardly projecting flange 22 at the top of the mounting device overhangs the top of the label holder pocket in the manner shown in FIG. 1.

In accordance with the invention, a sign holder device, generally designated by the reference numeral 25 is designed and constructed to be frictionally received on the projecting lower portion 20 of the label holder and to be sufficiently tightly retained thereon to enable typical large sign cards 26 or 27 to be supported thereby in the conventional parallel or perpendicular orientations.

The new sign clip device, which can advantageously be manufactured by injection molding of a plastic material such as polypropylene, comprises top and bottom walls 28, 29, outer side walls 30, 31 and inner side walls 32, 33. Forwardly opening U-shaped recesses 34, 35 are formed in the top and bottom walls respectively. The side walls of the recesses 34, 35 coincide generally with inner surfaces of the inner side walls 32, 33.

Figure 3:
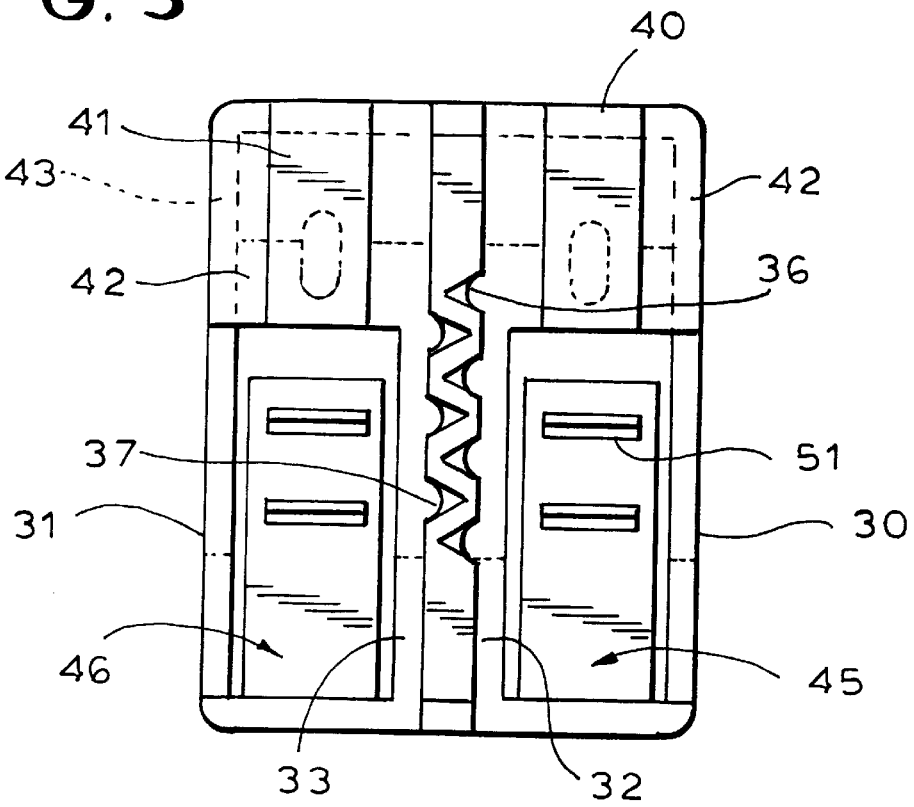
FIGS. 3 and 4 are front views of the clip of FIG. 1, with the FIG. 4 illustration additionally showing a sign card installed in the perpendicular orientation.
Figure 4:
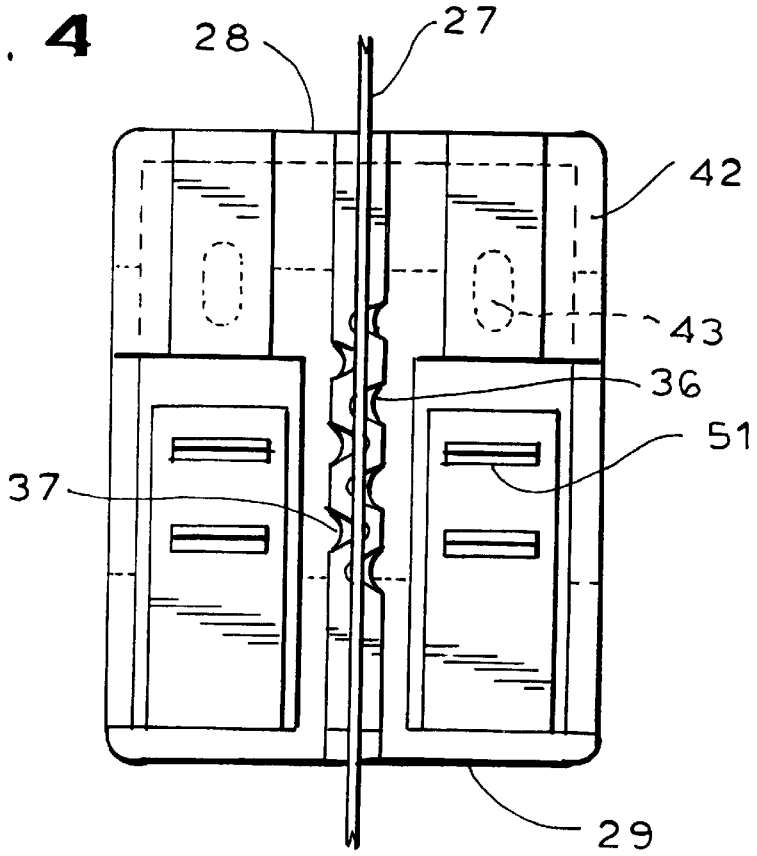

Projecting inward from the inner side walls 32, 33 are tapered projections 36, 37 arranged in alternating fashion such that the projections 36 of one side are disposed vertically between projections 37 on the other side. At the front, there is sufficient space between projections to facilitate the entry of a vertically oriented sign card intended to be held in perpendicular relation to the label holder 15. Farther into the recess, the projections extend further out from the walls 32, 33 and project into progressively overlapping relation with each other. Accordingly, as the edge of a sign card is inserted into the U-shaped recesses 34, 35 it enters easily but becomes firmly gripped and held in a slightly sinuous configuration by the projections, as is evident in FIGS. 3 and 4. This technique for securing of the perpendicular sign card is, in general, known.

At the front of the clip device, a pair of inverted L-shaped clip arms 40, 41 extend outward and then downward from front-facing wall panels 42. The clips are provided with rearwardly extending tapered projections 43 extending rearwardly, at least slightly beyond the front faces of the front wall panels 42. As indicated in FIG. 1, a sign card 26 can be inserted upwardly underneath the front clips 40. As the upper edge margin of the sign card passes the projections 43, portions of the card will be diverted and snugly held in the inserted position. This technique for holding of the sign card is, in general, known and used in existing devices.

In accordance with the invention, a pair of L-shaped mounting clips 45, 46 are provided at the back of the sign holder 25. These include horizontally extending portions 47 which preferably are integral with and extend rearwardly from the back edge of the bottom wall 29, and vertical portions 48 which extend upwardly, spaced from the back of the sign holder body. In the illustrated device, the inner and outer side walls 30–33 are provided with rearward abutment projections 49 formed with vertical abutment surfaces 50 which are located rearward of the back edges of the top and bottom walls 28, 29 and are spaced a predetermined distance in front of the vertical mounting clip portions 48, as shown particularly in FIG. 1. A plurality of flexible gripping tabs 51 project forwardly and preferably slightly downwardly from the vertical mounting clip portions 48, terminating in rearwardly spaced relation to the vertical abutment surfaces 50 of the projections 49.

As reflected in FIG. 1, the spacing between the forward extremities of the retaining tabs 51, and the vertical abutment surfaces 50 is slightly less than the thickness of the label holder 15. The sign holder may thus be installed on the label holder by inserting the projecting lower portion of the label holder into the space between the projections 49 and the flexible tabs 51. The tabs 51 will flex downward as necessary to allow the lower margin of the label holder to be received in the space provided. Once fully installed, in the position shown in FIG. 1, the deflected resilient tabs 51 serve to effectively resist downward movement of the sign holder.

As shown in the drawings, the inner and outer side walls 30–33, and the top and bottom walls 28, 29 define spaced apart openings extending through the sign holder body from front to back. In addition, as shown in FIG. 1, the lower extremities 52 of the front sign clips 40, 41 are above, or at least no lower than the upper extremities 53 of the mounting clips 45, 46. This provides front access of mold elements for formation of the mounting clips in an injection molding production process, and rear access of mold elements for formation of the sign clips 40, 41.

Figure 7:
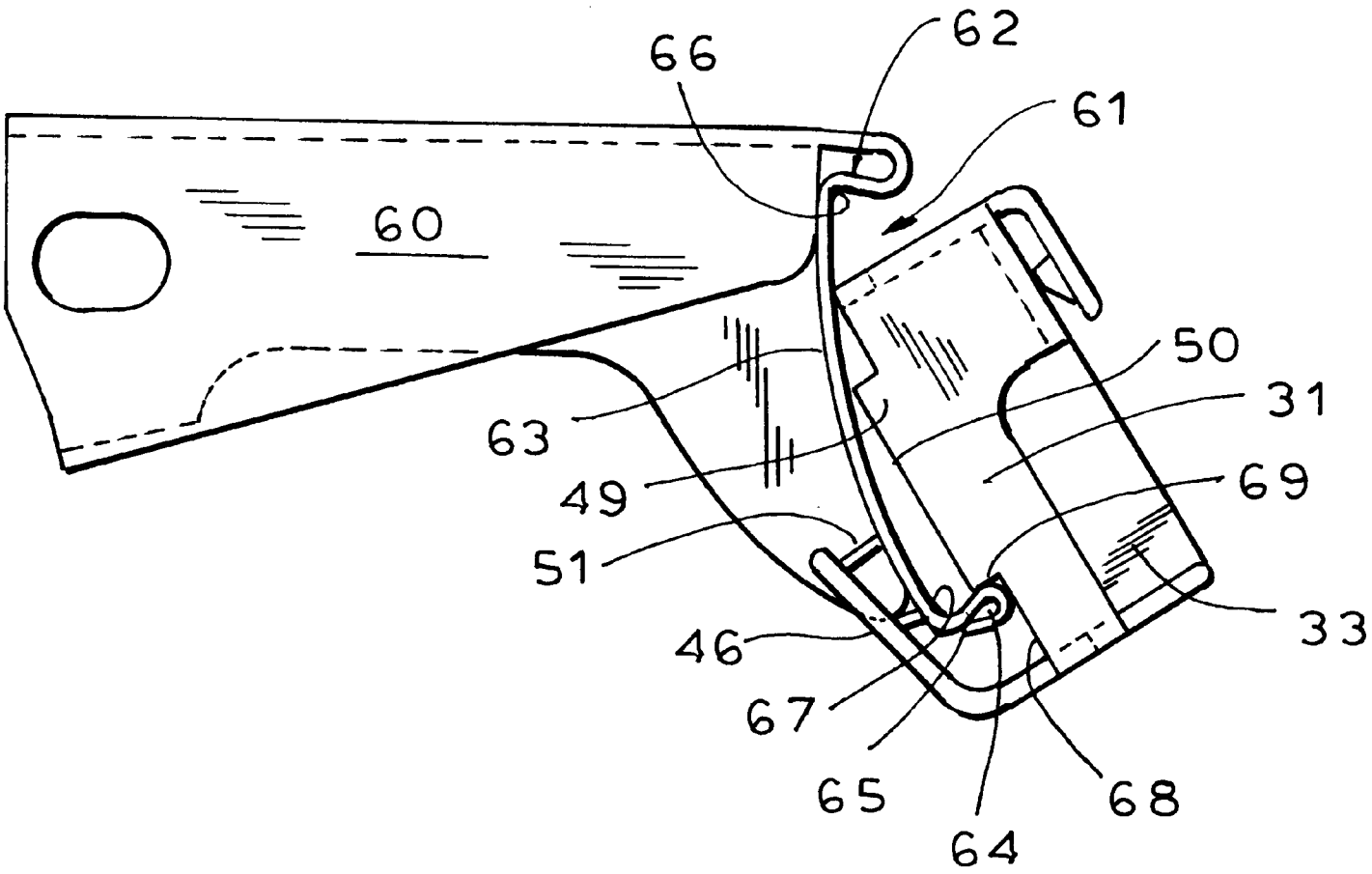
FIG. 7 is a side elevational view showing the new sign clip mounted upon the lower flange area of a conventional metal ticket molding.

The sign clip device to the invention is particularly advantageously employed in connection with standardized ticket moldings mounted along the front edges of product shelving, as shown in FIG. 7 of the drawings. In FIG. 7, the reference numeral 60 designates generally a shelf structure provided with a ticket molding 61 positioned at the front of the shelf for the retention and display of pricing labels. In the illustrated arrangement, the ticket molding is formed of rolled sheet metal, typically sheet steel. The sheet steel is shaped to provide an upper flange 62 of generally U-shaped configuration. The upper flange joins integrally with a display panel 63, formed in a shallow concave configuration. The display portion is joined integrally along its lower edge with a lower flange 64, which is also of a generally U-shaped configuration, but preferably is closed at 65 to minimize exposed edges.

For normal usage, the ticket molding 61 is arranged to receive a pricing label which is sized to fit snugly into the corner recesses 66, 67 formed where the upper and lower flanges 62, 65 join with the concave display section 63. Where the ticket molding is formed of rolled sheet metal, as illustrated in FIG. 7, the production processes dictate that the recesses 66, 67 are relatively shallow. This is quite adequate for the retention and display of pricing and information labels. On the other hand, conventional sign clips, such as the prior art product heretofore referred to are somewhat insecurely retained in a ticket molding of this configuration because mounting flanges of the sign clip are retained only by a relatively minimal return of the projecting flanges 62, 65. When a downward force is applied to a sign card mounted in such a conventional clip, a substantial torque is generated tending to pivot the sign clip about the lower recess 67. The small return of the overhanging upper flange 62 in many cases provides inadequate resistance to such torque, resulting in dislodgement of the sign clip from the shelf or ticket molding.

In accordance with the invention, the configuration of the abutment projections 49 of the new sign clip is such as to form recesses 68 at the lower back edges of the several sidewalls 30–33. Additionally, the lower edges of the several abutment projections 49 define downwardly facing, generally horizontal abutment surfaces 69.

The width and depth of the recess 68, along with the inherent elasticity of the L-shaped mounting clips 45, 46 and the resilience of the retaining tabs 51 projecting therefrom, are such as to enable the lower extremity of the ticket molding, including its forwardly projecting lower flange 65, to be inserted between the tabs 51 and the abutment projections 49 until the lower flange 65 of the ticket molding snaps under the bottoms of the abutment projections 49 and is engaged by the downwardly-facing abutment surface 69, substantially as shown in FIG. 7.

The resilient pressure of the L-shaped mounting clips 45, 46 causes upper portions of the sign clip to be pressed firmly against the front surface of the display portion 63, keeping the sign clip firmly locked in place on the ticket molding.

The device of the invention can be economically produced by injection molding procedures and permits sign cards to be utilized effectively in connection with roll-formed shelf or ticket moldings as well as with types of label holders which do not incorporate upper and lower flanges for the mounting of conventional sign clips. The device of the present invention, can be mounted on a variety of label holders having downwardly projecting margins which can be received in the mounting clip arrangement of the new device. As indicated in FIG. 1 of the drawings, the substantial space between the vertical portions 48 of the mounting clips and the abutment surfaces 50 accommodates label holder projections of a variety of sizes and configurations, and the resiliently deflectable retaining tabs 51 will be deflected as necessary to accommodate such variations.

Importantly, the device of the invention can be utilized to great advantage in connection with roll-formed or similar ticket moldings by reason of the locking recess 68, defined in part by the abutment projections 49. For installation, the sign clip is forced over the lower portion of the ticket molding, with the resilient mounting clips 45, 46 and their tabs 51 being deflected sufficiently to permit passage of the lower flange 64, until the flange becomes seated in the recess 68. The clip is thus firmly locked in place on the ticket molding against almost any kind of accidental dislodgement.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A molded plastic sign holder especially adapted for mounting of sign cards on a continuous label holder having a continuously extending, downwardly protecting label holding section, said sign holder comprising (a) a rigid body having a pair of spaced apart outer side walls and first and second inner side walls spaced from each other and from the outer side walls, (b) top and bottom walls rigidly joining said inner and outer side walls, (c) said top and bottom walls having forwardly opening recesses between said inner side walls to accommodate a vertically oriented sign card aligned with said recesses, (d) projections on each of said inner side walls extending into a space between said inner side walls and toward an inner side wall on an opposite side of said space, for gripping a side edge margin of a vertically oriented sign card positioned in said recesses, (e) said inner and outer side walls and said top walls forming spaced apart front-to-back openings in said body, (f) spaced apart sign clips having first portions extending forwardly from said top wall above said openings and second portions extending downward in front of upper portions of said openings, (g) said second sign clip portions having means for engagement and retention of an upper edge margin of a vertically oriented sign card, (h) spaced apart mounting clips having first portions extending rearwardly from said bottom wall below said openings and second portions extending upward in back of lower portions of said openings, (i) lower extremities of said sign clips being no lower than upper extremities of said mounting clips, and (j) at least certain of said side walls having portions defining rearwardly facing abutment surfaces, positioned in spaced relation to said second mounting clip portions, (k) said second mounting clip portions cooperating with said rearwardly facing abutment surfaces for engagement on and retention by a lower edge margin of said label holding section.

2. A plastic sign holder according to claim 1, wherein (a) said certain of said side walls are formed with rearwardly projecting portions defining said abutment surfaces, (b) said abutment surfaces being positioned rearwardly of rear edges of said top and bottom walls.

3. A plastic sign holder according to claim 2, wherein (a) said second mounting clip portions are formed with forwardly projecting, resilient retaining tabs positioned for cooperation with said abutment surfaces.

4. A plastic sign holder according to claim 1, wherein (a) said sign holder has locking recesses opposed to said mounting clips.

5. A plastic sign holder according to claim 1, wherein (a) said sign clips and said mounting clips are of no greater width than said front to back openings and are located in lateral alignment therewith.

6. A molded plastic sign holder for mounting of sign cards on a continuous label holder having a continuously extending lower edge margin exposed on front and back sides, said sign holder comprising (a) a rigid body having spaced apart side walls and top and bottom walls rigidly joining said side walls, (b) said side walls having rearwardly facing edges forming abutment surfaces, (c) at least one generally L-shaped mounting clip having a first portion extending rearward and a second portion extending upward from lower portions of said rigid body, (d) the second portion of said mounting clip having forwardly projecting, resilient retaining tabs and defining, with said abutment surfaces, a label holder-engaging recess.

7. A plastic sign holder according to claim 6, wherein a) each of said abutment surfaces comprises at least one abutment projection extending rearwardly from rearwardly facing edges of said side walls, and b) said recess is defined in part by said abutment projections.

* * * * *